US005306118A

United States Patent [19]

Holmes

[11] Patent Number: 5,306,118

[45] Date of Patent: Apr. 26, 1994

[54] MOUNTING GAS TURBINE OUTLET GUIDE VANES

[75] Inventor: Martin D. Holmes, Dunstable, England

[73] Assignee: Rolls-Royce plc, London, England

[21] Appl. No.: 67,032

[22] Filed: May 26, 1993

[30] Foreign Application Priority Data

Jun. 4, 1992 [GB] United Kingdom ..... 9211821.5

[51] Int. Cl.[5] ..... F01D 17/00

[52] U.S. Cl. ..... 415/146; 415/141

[58] Field of Search ..... 415/141, 146, 209.3, 415/211.2

[56] References Cited

U.S. PATENT DOCUMENTS

| | | | |
|---|---|---|---|
| 1,030,679 | 6/1912 | Pierce | 415/141 |
| 1,136,877 | 4/1915 | Homersham | 415/146 |
| 3,695,777 | 10/1972 | Westphal et al. | 415/209.3 |
| 3,857,649 | 12/1974 | Schaller et al. . | |
| 3,957,392 | 5/1976 | Blackburn | 415/146 |
| 5,078,576 | 1/1992 | Hayton | 415/209.3 |

FOREIGN PATENT DOCUMENTS

| | | | |
|---|---|---|---|
| 0250234 | 7/1926 | United Kingdom | 415/141 |
| 2251001A | 6/1992 | United Kingdom . | |

*Primary Examiner*—Edward K. Look
*Assistant Examiner*—Mark Sgantzos
*Attorney, Agent, or Firm*—Oliff & Berridge

[57] ABSTRACT

An assembly for supporting knitted outlet guide vanes in a gas turbine engine comprises an exhaust difusser cone, an exhaust discharge duct surrounding and coaxial with the diffuser cone, and an annular array of the vanes extending radially between the diffuser cone and the discharge duct. Each guide vane has a root engaging the diffuser cone, and a tip. Each vane is mounted adjacent its tip to the discharge duct so as to pivot about an axis extending through the vane. A spring means is provided to urge each vane into engagement with the exhaust diffuser cone.

5 Claims, 3 Drawing Sheets

MOUNTING GAS TURBINE OUTLET GUIDE VANES

BACKGROUND OF THE INVENTION

This invention relates to gas turbine engines and particularly to the mounting of outlet guide vanes in the exhaust duct of such engines.

Outlet guide vanes of a gas turbine engine form an annular array positioned immediately to the rear of the turbine stage and are employed to straighten the flow of hot exhaust gas emanating from the combustion chambers and which have been swirled during their passage through the turbine. The vanes extend radially between the inner wall of the exhaust nozzle and the outer wall of the exhaust diffuser cone which is co-axial within the exhaust nozzle. The cone may move axially a small amount between a forward position when the engine is not running, and a rearward position when the engine is running due to the gas flow through the exhaust nozzle applying a rearwardly directed force upon the cone.

Due to the very high temperature of the exhaust gas it is necessary to manufacture outlet guide vanes from very specialized materials such as ceramic and, in one particular case, outlet guide vanes which comprise blades of aerofoil section with end plates are integrally moulded from a sleeve of a knitted ceramic. Such vanes are known as knitted vanes; they are structurally weak and, because they are secured to the engine structure at one end only so as to allow their unrestricted radial extension, their mounting arrangements are difficult to provide. Knitted ceramic vanes are discussed in the present applicant's published British Patent Specification 2,251,001A.

It is an object of the present invention to provide a means of mounting knitted vanes in an annular array which provides their freedom of radial extension, allows axial movement of the exhaust diffuser cone and enables the rearward load applied to the cone by the exhaust gas to be supported more evenly by all of the vanes in the array.

SUMMARY OF THE INVENTION

According to one aspect of the present invention in a gas turbine engine an outlet guide vane assembly comprises an exhaust diffuser cone, an exhaust discharge duct surrounding and co-axial with said diffuser cone, an annular array of outlet guide vanes extending radially between said diffuser cone and said discharge duct, each guide vane in said array having a root and a tip, engagement means whereby each said root engages said diffuser cone, pivotal mounting means whereby each said vane is mounted adjacent its tip to the discharge duct so as to pivot about an axis extending through the vane, and spring means acting on each said vane whereby each said vane is urged into engagement with said exhaust diffuser cone.

In a preferred form of the invention each outlet guide vane in said array is a knitted ceramic guide vane and is provided with end plates adjacent the root and tip, which plates form continuations of the exhaust diffuser cone and the exhaust discharge duct. The root and tip of each such outlet guide vane may be extended radially beyond said end plates so that the extension at the root of the vane may engage a recess in the wall of the diffuser cone, and the extension at the tip of the vane may be provided with pivot mounting means whereby the vane may be pivotally mounted at its forward end so that it may rotate in a plane extending through the engine axis, and spring means whereby the vane may be urged to rotate in that plane so as to direct the vanes into positions in which the load exerted on each vane in said array by the exhaust acting upon the diffuser cone may be more uniformly distributed throughout the vanes in the array.

One embodiment of the invention will now be described by way of example with reference to the accompanying drawings in which:

DETAILED DESCRIPTION OF THE PREFERRED EMBODIMENT

Figure 1:
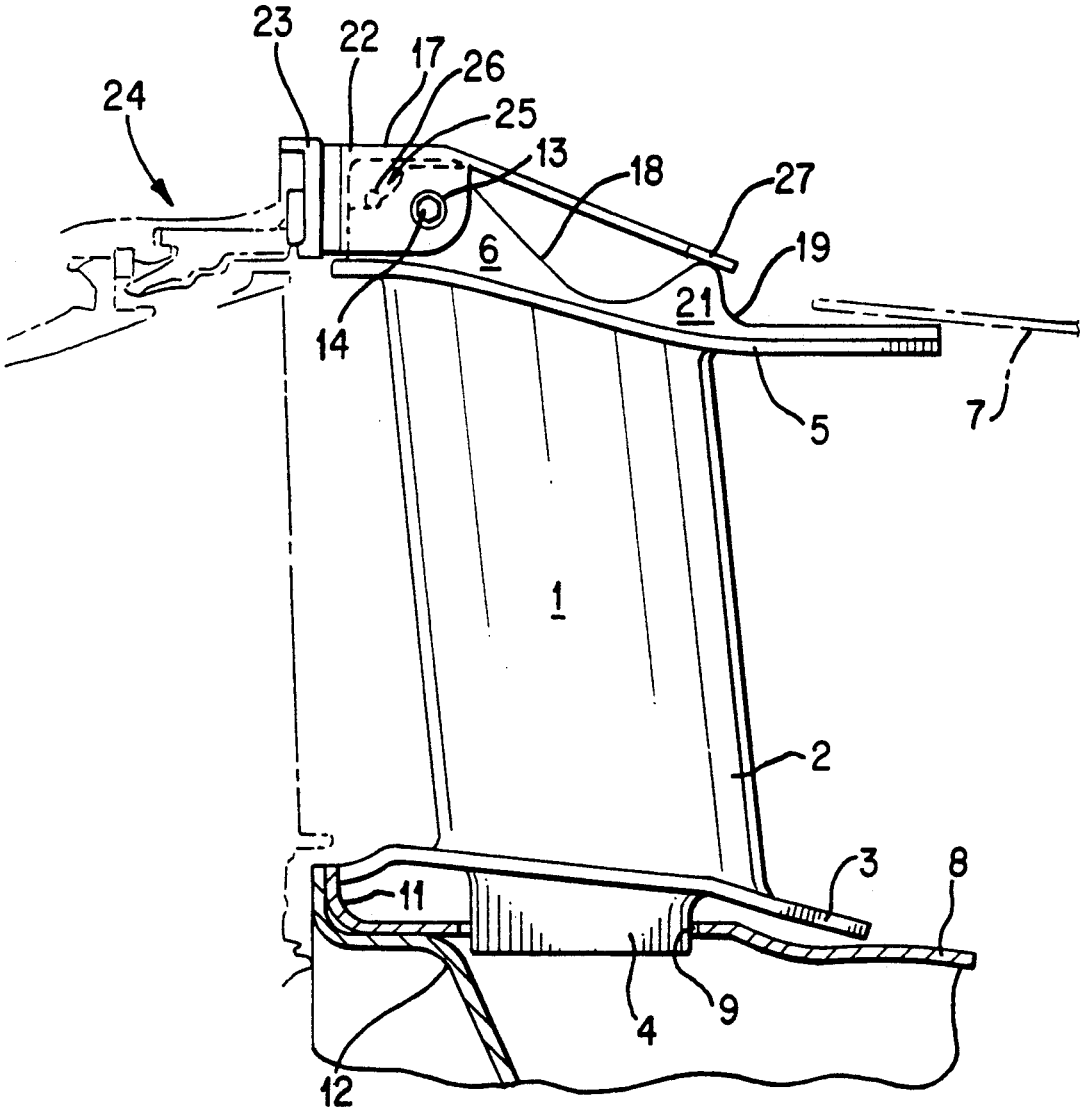
FIG. 1 shows a side view of an outlet guide vane pivotally mounted upon an exhaust nozzle structure and in engagement with an exhaust diffuser cone.
Figure 2:
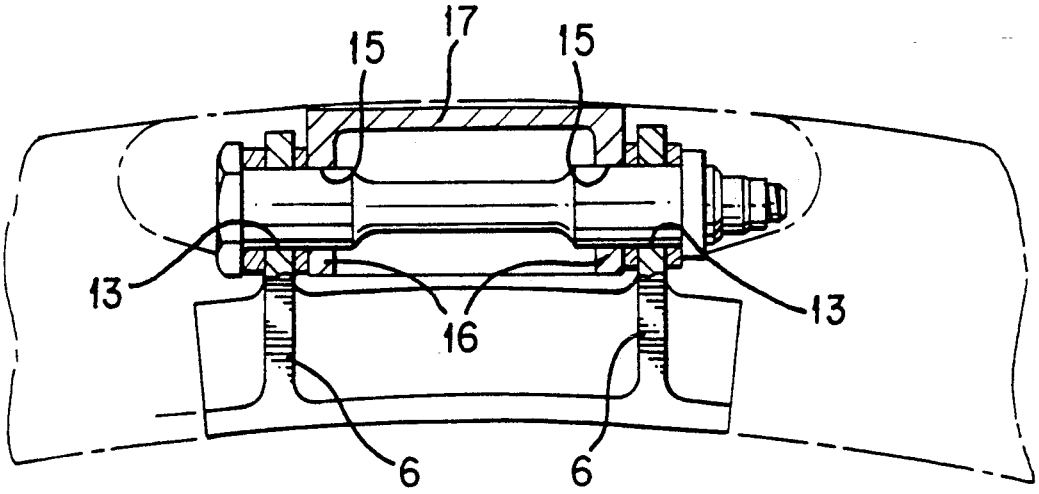
FIG. 2 shows a front view of the pivotal mounting of the vane shown in FIG. 2.

Referring to the drawings an outlet guide vane 1 moulded from a sleeve of knitted ceramic material comprises a blade 2 of aerofoil section bearing an inner shroud plate 3, an inwardly directed extension member 4, an outer shroud plate 5, and an outwardly directed extension member consisting of two spaced apart pieces 6,6.

The vane 1 is shown as being located between an exhaust nozzle 7 and a diffuser cone 8 co-axially within the nozzle.

The diffuser cone 8 is apertured at 9 to receive the extension member 4 of the vane and, at its forward end, the cone 8 is outwardly flanged at 11 for connection to a forward diaphragm member 12 forming part of the cone structure. The flange 11 forms an abutment for the forward end of the inner shroud plate 3.

Each of the extension pieces 6,6 is apertured at 13 to receive a pivot bolt 14 which is also received in apertures 15,15 in flanges 16,16 depending from the forward end of a leaf spring member 17. The extension pieces 6,6 are relieved at 18 and 19 so as to leave upstanding portions 21,21 which act as abutments for the leaf spring member 17. The spring member 17 is secured by a flange 22 at its forward end to engine structure 23 at the rearward end of the turbine stage indicated generally at 24. The portions 19,19 of the extension pieces 6,6 extend rearwardly so as to reinforce the outer plate 5.

Forward of the pivot bolt 14 the extension pieces 6,6 are recessed at 25 to receive a sealing strip 26.

Figure 3:
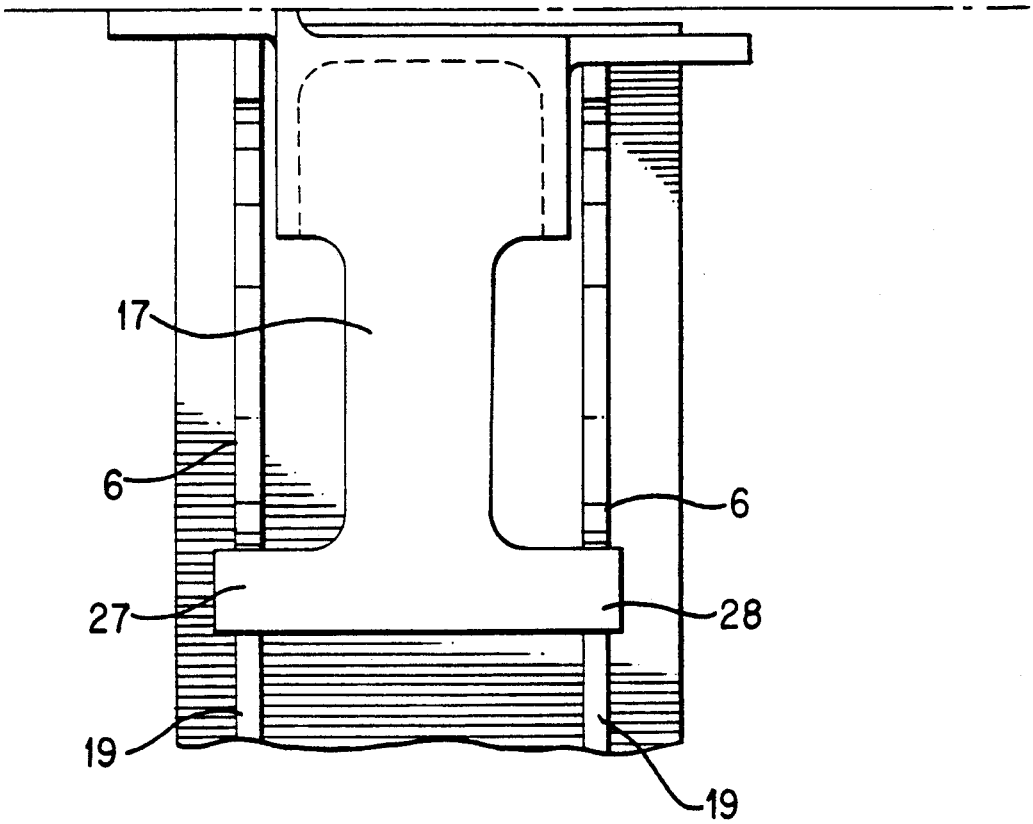
FIG. 3 shows a plan view of the assembly shown in FIGS. 1 and 2.

As can be seen in FIG. 3 the rear end of spring member 17 is provided with outwardly extending wings 27,28 which engage the upstanding portions 19,19 of the plate extension pieces 6,6.

When the engine is operating, hot gas from the combustion chambers passes through the turbine stage 24 and into the passage formed between the walls of the nozzle 7 and diffuser cone 8, the swirling of the gas being reduced by the outlet guide vanes 1 as it does so. The effect of the pressure in the gas flow as it passes through the passage is such that the cone 8 is sucked rearwardly and this causes the cone 8 to be displaced to the rear. As this occurs, the flange 11 at the forward end of the cone pushes each vane plate 3 to the rear thereby pivoting the vanes about their pivot bolts 14. This action is resisted by the spring member 17 the wings 27,28 of which press against the upstanding portions 19,19 of the outer plate 5. Each vane in the array will be subjected to similar loading from the cone flange 11 so that the rearwardly directed load on the diffuser cone will be absorbed more evenly by all of the vanes in the array. It will be seen that each vane is free to extend radially inwardly and the extension of the vane due to the high operating temperature is not restricted in any way.

I claim:

1. In a gas turbine engine, an assembly comprising: an exhaust diffuser cone, an exhaust discharge duct surrounding and co-axial with said exhaust diffuser cone, an annular array of outlet guide vanes extending between said exhaust diffuser cone and said exhaust discharge duct, each guide vane in said array having a root and a tip, engagement means whereby each said root engages said exhaust diffuser cone, pivot mounting means whereby each said vane is pivoted at its tip so as to rotate about an axis extending through the tip of the vane, and a leaf spring acting on each said guide vane whereby each said guide vane is urged into engagement with said diffuser cone.

2. An assembly as claimed in claim 1 wherein each outlet guide vane in said array comprises a knitted ceramic guide vane.

3. An assembly as claimed in claim 1 wherein each said outlet guide vane in said array is provided with inner and outer shroud plates respectively adjacent said root and tip, wherein said plates respectively form continuations of said exhaust diffuser cone and said exhaust discharge duct.

4. An assembly as claimed in claim 3 wherein said root of each outlet guide vane is extended radially inwards of the inner shroud plate so that the extension at the root of said vane may engage a recess in the wall of the diffuser cone.

5. An assembly as claimed in claim 3, wherein said tip of each outlet guide vane is extended radially outwards of the outer shroud plate so as to provide said pivot mounting means, wherein said vane may be pivotally mounted relative to the exhaust discharge duct for rotation in a plane extending through the axis of the engine.

* * * * *